US009168746B2

(12) United States Patent
Usuda

(10) Patent No.: US 9,168,746 B2
(45) Date of Patent: Oct. 27, 2015

(54) PRINTING APPARATUS AND PRINTING METHOD

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 171 days.

(21) Appl. No.: 13/549,739

(22) Filed: Jul. 16, 2012

(65) Prior Publication Data

US 2013/0027487 A1 Jan. 31, 2013

(30) Foreign Application Priority Data

Jul. 26, 2011 (JP) ..... 2011-163101

(51) Int. Cl.
*B41J 2/14* (2006.01)
*B41J 2/21* (2006.01)
*B41J 11/00* (2006.01)

(52) U.S. Cl.
CPC ..... *B41J 2/14274* (2013.01); *B41J 2/2114* (2013.01); *B41J 11/002* (2013.01)

(58) Field of Classification Search
CPC ..... B41J 2/2114
See application file for complete search history.

(56) References Cited

U.S. PATENT DOCUMENTS

| | | | | |
|---|---|---|---|---|
| 2005/0046684 | A1* | 3/2005 | Yoneyama | 347/102 |
| 2005/0156964 | A1* | 7/2005 | Hoshino | 347/9 |
| 2005/0237352 | A1 | 10/2005 | Yoneyama | |
| 2011/0085013 | A1 | 4/2011 | Onishi et al. | |
| 2014/0049584 | A1 | 2/2014 | Onishi et al. | |

FOREIGN PATENT DOCUMENTS

| | | |
|---|---|---|
| JP | 2003-191594 | 7/2003 |
| JP | 2011-068055 | 4/2011 |
| JP | 2011-083915 | 4/2011 |
| JP | 2011-110818 | 6/2011 |
| WO | 2005-105452 | 11/2005 |

* cited by examiner

*Primary Examiner* — Justin Seo
(74) *Attorney, Agent, or Firm* — Workman Nydegger

(57) ABSTRACT

A printing apparatus includes a carriage having a recording head movable in a first direction relative to a medium, a color ink nozzle row and a clear ink nozzle row that are provided in the recording head and that respectively eject photo-curable color ink and photo-curable clear ink, and a light irradiation section. A first period of time from when the color ink is deposited on the medium to when light is emitted by the light irradiation section is equal to or longer than a second period of time from when the clear ink is deposited on the medium to when the light is emitted by the light irradiation section.

2 Claims, 12 Drawing Sheets

FIG. 9A

SCHEMATIC DIAGRAM ILLUSTRATING A SURFACE STATE IN THE CASE WHERE THE PERIOD OF TIME (SECOND TIME PERIOD) FROM WHEN CLEAR INK IS DEPOSITED TO WHEN ULTRAVIOLET LIGHT IS EMITTED BY ULTRAVIOLET LIGHT IRRADIATION UNIT 160b IS EQUAL TO OR SHORTER THAN THE FIRST TIME PERIOD

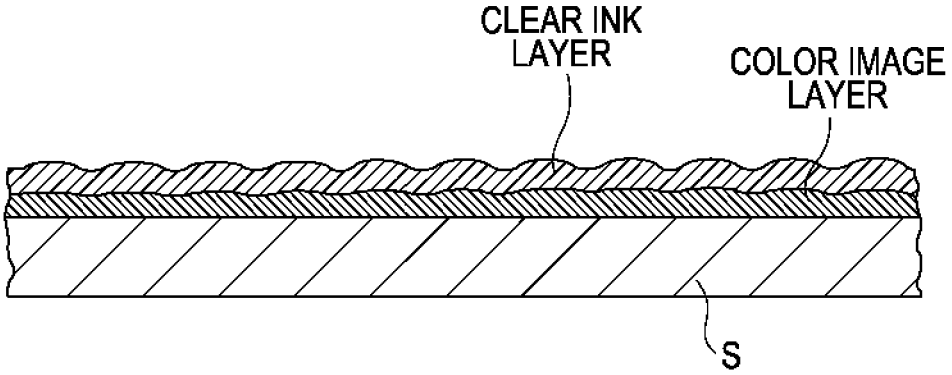

FIG. 9B

SCHEMATIC DIAGRAM ILLUSTRATING A SURFACE STATE IN THE CASE WHERE THE PERIOD OF TIME (SECOND TIME PERIOD) FROM WHEN CLEAR INK IS DEPOSITED TO WHEN ULTRAVIOLET LIGHT IS EMITTED BY ULTRAVIOLET LIGHT IRRADIATION UNIT 160b IS LONGER THAN THE FIRST TIME PERIOD

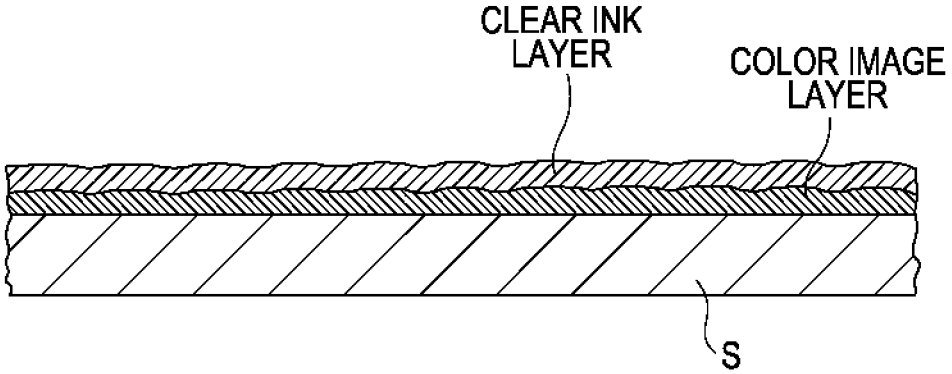

PRINTING APPARATUS AND PRINTING METHOD

BACKGROUND

1. Technical Field

The present invention relates to a printing apparatus, such as an ink jet printer, and a printing method used for the printing apparatus.

2. Related Art

Some known printing apparatuses are ink jet printers that eject ink (liquid) onto recording media (target).

Some of such printing apparatuses include an ejection section that ejects ink (e.g., colored ink) onto a medium and an irradiation section that irradiates the ink on the medium with ultraviolet light so as to cure the ink. The ink which has been ejected from the ejection section and deposited on the medium is irradiated with ultraviolet light so as to be cured, and, as a result, an image is printed. JP-A-2003-191594 is an example of related art.

Various imaging effects are required to be provided by the above-mentioned printing apparatuses.

For example, in order to provide a glossy-surface image, which is required, colorless ink (clear ink) is ejected by the ejection section. The colorless ink is ejected onto colored ink that has been deposited on a medium (the colored ink has been cured by irradiation with ultraviolet light), and subsequently the ink is irradiated with ultraviolet light. Hence, a layer of the colorless ink (flat layer) is formed on the colored ink, so that an overall glossy image is printed.

However, although hitherto known ink jet printing apparatuses can apply the above-mentioned gloss to an image, it is difficult to form an image with an uneven surface and thus to give the image a three-dimensional appearance, a so-called textured image.

SUMMARY

In order to solve the problem described above, the present invention provides the following aspects. A printing apparatus according to an aspect of the invention includes a carriage movable in a first direction relative to a medium, a recording head that is provided in the carriage and that ejects color ink or clear ink which is cured by irradiation with light, a color ink nozzle row that is provided in the recording head and that ejects the color ink which is cured by irradiation with light, a clear ink nozzle row that is provided in the recording head and that ejects the clear ink which is cured by irradiation with light, a movement mechanism that performs relative movement of the carriage and the medium in a second direction that is perpendicular to the first direction, and a light irradiation section that is provided in the carriage and that emits the light. In the printing apparatus, the period of time from when the color ink is deposited on the medium to when the light is emitted by the light irradiation section is defined as a first time period, the period of time from when the clear ink is deposited on the medium to when the light is emitted by the light irradiation section is defined as a second time period, and the second time period is equal to or shorter than the first time period.

In the printing apparatus according to the aspect of the invention, it is preferable that the distance in the first direction between the color ink nozzle row and the light irradiation section is defined as a first distance, the distance in the first direction between the clear ink nozzle row and the light irradiation section is defined as a second distance, and the first distance is greater than or equal to the second distance.

A printing apparatus according to another aspect of the invention includes a carriage movable in a first direction relative to a medium, a recording head that is provided in the carriage and that ejects color ink or clear ink which is cured by irradiation with light, a color ink nozzle row that is provided in the recording head and that ejects the color ink which is cured by irradiation with light, a clear ink nozzle row that is provided in the recording head and that ejects the clear ink which is cured by irradiation with light, a movement mechanism that performs relative movement of the carriage and the medium in a second direction that is perpendicular to the first direction, and a light irradiation section that is provided in the carriage and that emits the light. In the printing apparatus, the distance in the first direction between the color ink nozzle row and the light irradiation section is defined as a first distance, the distance in the first direction between the clear ink nozzle row and the light irradiation section is defined as a second distance, and the first distance is greater than or equal to the second distance.

A printing method according to a further aspect of the invention uses a carriage movable in a first direction relative to a medium, a recording head that is provided in the carriage and that ejects color ink or clear ink which is cured by irradiation with light, a color ink nozzle row that is provided in the recording head and that ejects the color ink which is cured by irradiation with light, a clear ink nozzle row that is provided in the recording head and that ejects the clear ink which is cured by irradiation with light, a movement mechanism that performs relative movement of the carriage and the medium in a second direction that is perpendicular to the first direction, and a light irradiation section that is provided in the carriage and that emits the light. In the printing method, the period of time from when the color ink is deposited on the medium to when the light is emitted by the light irradiation section is defined as a first time period, the period of time from when the clear ink is deposited on the medium to when the light is emitted by the light irradiation section is defined as a second time period, and the second time period is equal to or shorter than the first time period.

In the printing apparatus and the printing method according to the aspects of the invention, the period of time from when the color ink is deposited on the medium to when the light is emitted by the light irradiation section is defined as the first time period, the period of time from when the clear ink is deposited on the medium to when the light is emitted by the light irradiation section is defined as the second time period, and the second time period is equal to or shorter than the first time period. The clear ink is cured prior to sufficient leveling after the clear ink has been deposited. Thus, in accordance with the printing apparatus and the printing method, an image with an uneven surface may be formed so as to provide a textured image with a three-dimensional appearance, thereby allowing for an increase in the number of imaging effects provided by the printing apparatus.

BRIEF DESCRIPTION OF THE DRAWINGS

The invention will be described with reference to the accompanying drawings, wherein like numbers reference like elements.

FIGS. 9A and 9B are schematic diagrams illustrating the difference between surface states corresponding to different periods of time from ink deposition to ink curing.

DESCRIPTION OF EXEMPLARY EMBODIMENTS

Figure 1:
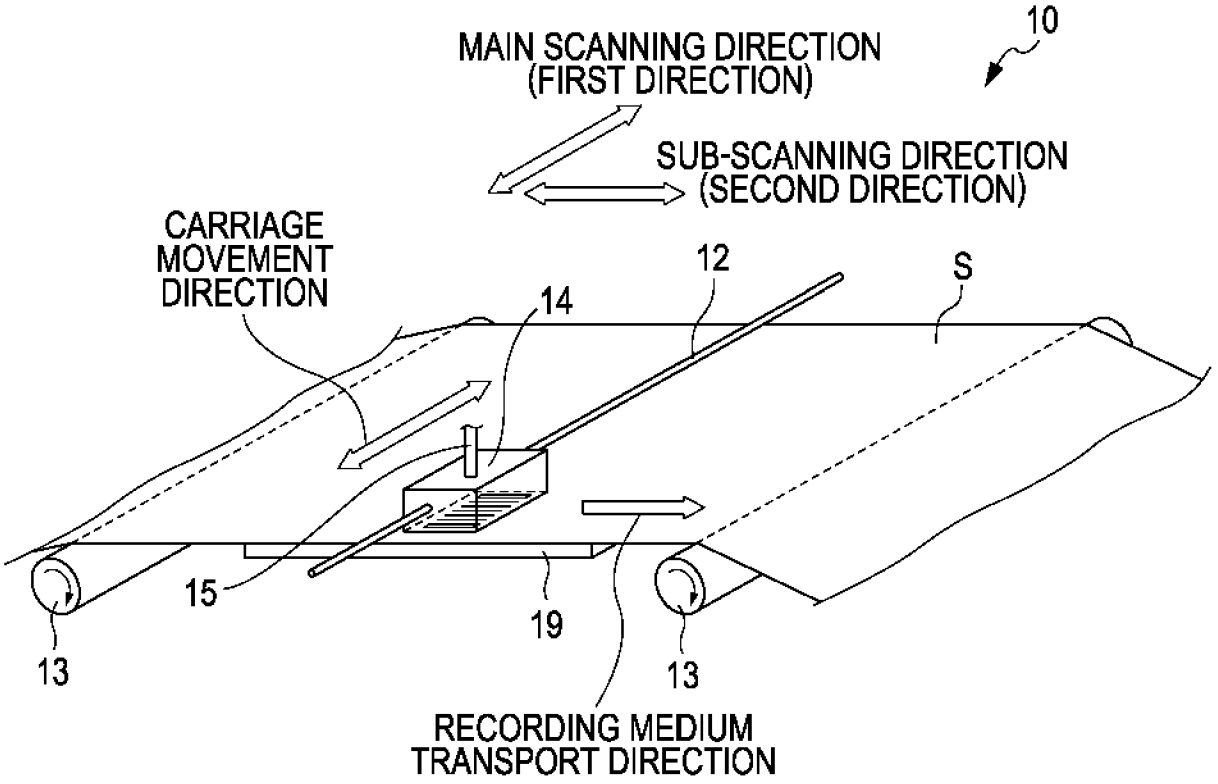
FIG. 1 illustrates an outline of a printing apparatus according to an embodiment of the invention.
Figure 2:
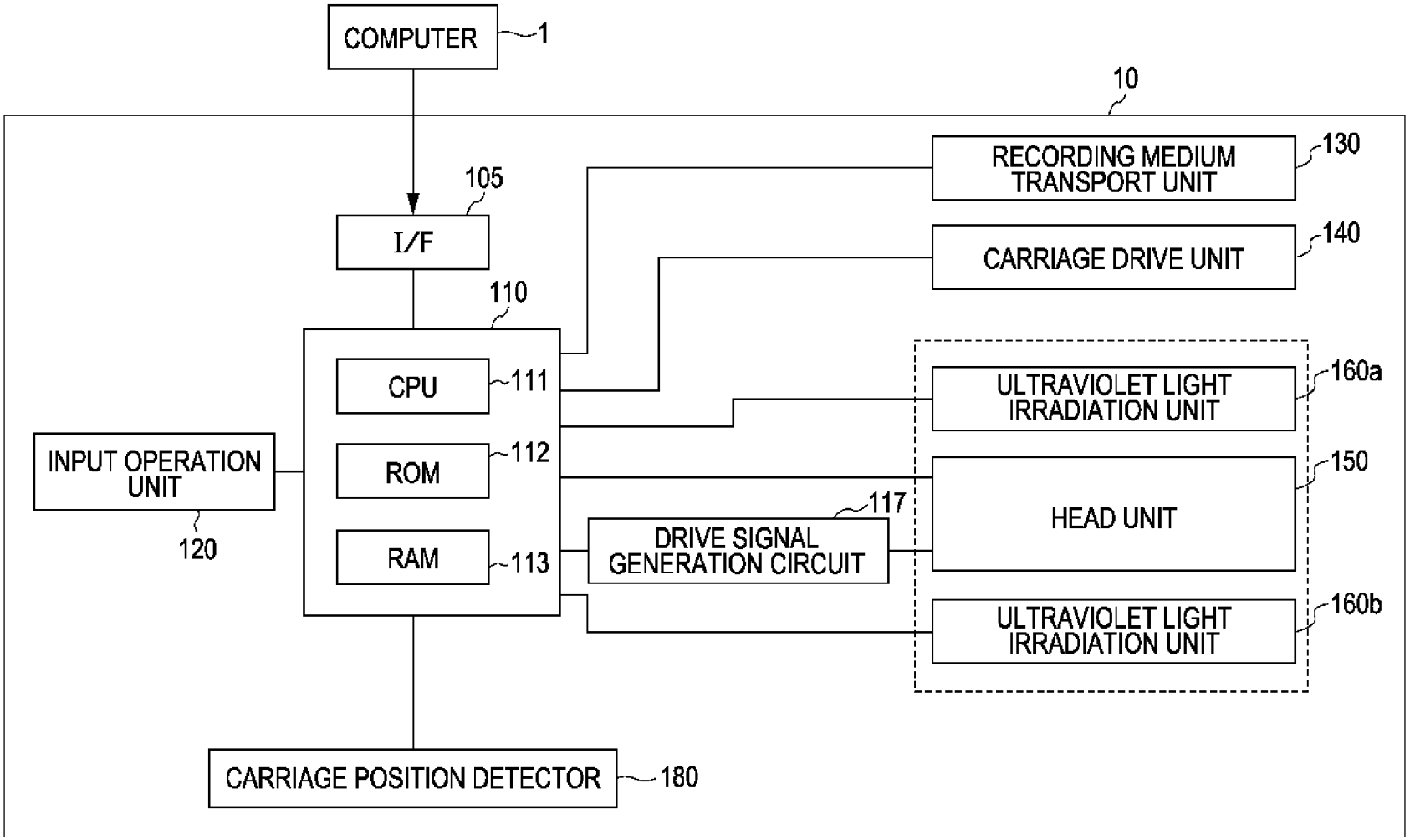
FIG. 2 is a block diagram of the overall structure of the printing apparatus.
Figure 3:
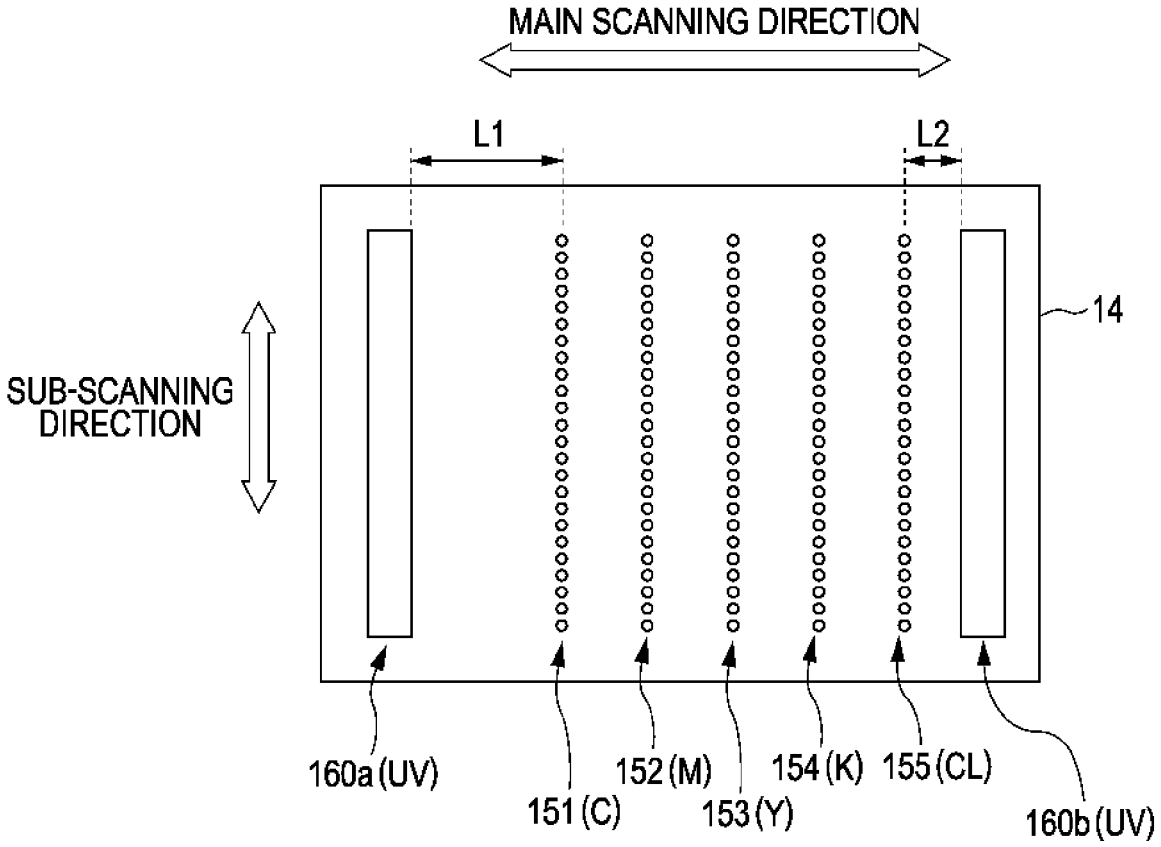
FIG. 3 illustrates a head unit and ultraviolet light irradiation units which are mounted in a carriage of the printing apparatus.

Embodiments of the invention will be described below with reference to the accompanying drawings. FIG. 1 illustrates an outline of a printing apparatus 10 according to an embodiment of the invention, which is a serial head type ink jet recording apparatus. FIG. 2 is a block diagram of the overall structure of the printing apparatus 10. FIG. 3 illustrates a head unit 150 and ultraviolet light irradiation units 160*a* and 160*b* which are mounted in a carriage 14 in the printing apparatus 10.

As illustrated in FIG. 1, the printing apparatus 10 includes a rod-shaped guide rail 12 by which a carriage 14 is supported. The carriage 14 is reciprocated along the guide rail 12 in a main scanning direction (first direction) by a carriage drive unit 140 (see FIG. 2).

A head unit 150 is mounted at a central portion of the carriage 14. The head unit 150 includes nozzles which respectively eject yellow (Y) ink, magenta (M) ink, cyan (C) ink, black (K) ink, and clear (CL) ink onto a recording medium S. The color inks of yellow (Y), magenta (M), cyan (C), and black (K) among the inks ejected from the head unit 150 are typically used as image recording ink so as to render a predetermined image based on image data received from a computer 1 or the like which is a higher-level device.

The clear (CL) ink is ejected from the head unit 150 onto an image formed with the yellow (Y), magenta (M), cyan (C), and black (K) inks on the basis of clear ink ejection data received from the computer 1 which is the higher-level device, so that the image is given a glossy and/or a textured surface. The clear (CL) ink is clear, colorless ink. The yellow (Y) ink, magenta (M) ink, cyan (C) ink, and black (K) ink are colored ink (color ink). That is, the head unit 150 ejects the colored ink and the colorless ink onto the recording medium S.

Hereinafter, yellow or yellow ink may be abbreviated as "Y" or the like.

An ink supply tube 15 connected to the carriage 14 supplies the ink of each color from an ink tank, which is not illustrated, to the head unit 150.

The computer 1 transmits image data corresponding to an image to be printed to the printing apparatus 10 via a printer driver. The image data includes pixel data representing whether or not the ink of each color is to be ejected for each of pixels of the medium.

The ink used in the embodiment is ultraviolet-curable UV ink which is cured by irradiation with ultraviolet light. Examples of the ultraviolet-curable ink which may be used include a radically polymerizable ink containing a radically polymerizable compound as a polymerizable compound, a cationically polymerizable ink containing a cationically polymerizable compound as the polymerizable compound, and a hybrid ink which is a composite of the radically polymerizable ink and the cationically polymerizable ink. Also, as the ink, there may be used a polymerizable compound which is polymerized and cured using light other than ultraviolet light, and a photoinitiator which initiates a polymerization reaction between polymerizable compounds using light other than ultraviolet light, for example, electron beams, X-rays, or infrared rays.

In the printing apparatus 10 according to the embodiment, examples of a material which may be used for the recording medium S include various kinds of paper, such as plain paper, recycled paper, and glossy paper, various fabrics, various non-woven fabrics, resins, metals, glass, and resin films. As the resin of the resin films, for example, polyethylene terephthalate (PET), polyester (PS), or polypropylene (PP) is preferably used.

The head unit 150 is connected to a controller 110 and a drive signal generation circuit 117. A drive signal COM, a signal for controlling ink ejection, and the like are transmitted to the head unit 150.

The ultraviolet light irradiation units 160*a* and 160*b* as light irradiation devices, which irradiate the ink ejected onto the recording medium S from the nozzles with ultraviolet light, are respectively provided on the two side portions of the head unit 150 in the carriage 14 so as to extend from an upstream end to a downstream end of a sub-scanning direction (second direction) which is perpendicular to the main scanning direction (first direction) of the head and in which the recording medium S is transported.

A central portion of a movable range of the carriage 14 is a recording region in which recording is performed on the recording medium S. The recording region is provided with a platen 19 which supports the recording medium S in a horizontal position from a non-recording surface side thereof.

The printing apparatus 10 is provided with a recording medium transport unit 130 (see FIG. 2) which is constituted by a plurality of transport rollers 13 and the like and transports the recording medium S in the sub-scanning direction (second direction). When the image is recorded, the recording medium transport unit 130 alternately transports and stops the transport of the recording medium S in accordance with operation of the carriage 14 so as to intermittently transport the recording medium S.

The printing apparatus 10 is provided, on the top surface of the housing (not illustrated) thereof, with an input operation unit 120 constituted by, for example, a touch panel. The input operation unit 120 displays user-selectable recording modes and a user selectively inputs a displayed recording mode therethrough. The input operation unit 120 is connected to the controller 110, which will be described below, and outputs a signal representing the recording mode selected on the basis of a predetermined operation to the controller 110.

FIG. 2 illustrates control blocks for controlling the printing apparatus 10 in the embodiment. The controller 110 in the control blocks is constituted by, for example, a CPU 111, a ROM 112, and a RAM 113. A processing program recorded in the ROM 112 is expanded in the RAM 113 and then the CPU 111 performs this processing program. An interface 105 is provided to connect the controller 110 of the printing apparatus 10 to the computer 1.

In accordance with the processing program, the controller 110 controls an operation of each of members on the basis of states, such as operational states of the recording medium transport unit 130, the carriage drive unit 140, the head unit 150, the ultraviolet light irradiation units 160, and so forth. A carriage position detector 180 is constituted by a position detecting sensor (not illustrated) or the like which detects an original position of the carriage 14. Detection information generated by the carriage position detector 180 is input to the controller 110 and is utilized for a driving process of the carriage drive unit 140.

The drive signal generation circuit 117 generates the drive signal COM, which will be described below. The drive signal generation circuit 117 obtains data on a waveform of the drive signal COM from the controller 110. The drive signal generation circuit 117 generates a voltage signal on the basis of the data on the waveform, and performs power amplification on the voltage signal, thereby generating the drive signal COM. An example of the waveform of the drive signal COM will be described below.

The ultraviolet light irradiation units 160*a* and 160*b* are devices for irradiating the UV ink ejected on the medium with the ultraviolet light so as to cure the UV ink. A light source of the ultraviolet light irradiation units 160*a* and 160*b* is constituted by, for example, an ultraviolet light emitting diode (UV-LED) which generates ultraviolet light. An irradiation rate of the ultraviolet light may be controlled by the controller 110 to thereby change an irradiation amount of the ultraviolet light at each position on the recording medium S. Other examples of the light source which may be used include a metal halide lamp, a xenon lamp, a carbon arc lamp, a chemical lamp, a low-pressure mercury lamp, and a high-pressure mercury lamp.

In the printing apparatus 10, the controller 110 controls the head unit 150, the recording medium transport unit 130, and so forth so that the ejection order of the ink from the head unit 150 is changed in accordance with the recording mode and the ink is ejected to record the image.

The head unit 150 mounted in the carriage 14 of the printing apparatus 10 will be described with reference to FIG. 3. FIG. 3 schematically illustrates the bottom of the carriage 14 (surface facing the recording medium S). As illustrated, the head unit 150 includes nozzle rows 151 to 155, each including a plurality of nozzles aligned in the sub-scanning direction. In the embodiment, each nozzle row is composed of 180 nozzles. The number of nozzles in the nozzle row illustrated in the figure is reduced. The nozzle rows 151 to 155 correspond to the colors of the ink ejected from the head unit 150. That is, the nozzle rows 151 to 155 are constituted by a nozzle row 151 for cyan ink ejection, a nozzle row 152 for magenta ink ejection, a nozzle row 153 for yellow ink ejection, a nozzle row 154 for black ink ejection, and a nozzle row 155 for clear ink ejection.

In the embodiment, the nozzle rows corresponding to the ink colors each include nozzles arranged in a line. However, the arrangement of the nozzles in one nozzle row is not especially limited. For example, the nozzles may be arranged in multiple lines so as to form a zigzag pattern.

In the head unit 150 illustrated in FIG. 3, all the nozzle rows 151 to 155 are provided in a single head structure. However, the nozzles of each of the nozzle rows 151 to 155 may be provided in a different head structure and the different head structures may be mounted in the carriage 14. When such a different head structure is formed, a single head structure corresponding to one nozzle row or a single head structure corresponding to a plurality of nozzle rows may be formed.

The two ultraviolet light irradiation units 160*a* and 160*b* are disposed on both ends of the bottom of the carriage 14 such that the nozzle rows 151 to 155 are interposed therebetween. The ultraviolet light irradiation units 160*a* and 160*b* irradiate all of the inks ejected from the nozzle rows 151 to 155 with the ultraviolet light while the carriage 14 is being scanned in the main scanning direction. The ink ejected from each nozzle row is irradiated with light by the ultraviolet light irradiation units 160*a* and 160*b* so as to be cured.

In the carriage 14 of the printing apparatus 10 according to the embodiment, the distance in the first direction between the color ink nozzle rows 151 to 154 and the ultraviolet light irradiation unit 160*a* (which performs irradiation when the color ink is ejected) is defined as a first distance L1, the distance in the first direction between the clear ink nozzle row 155 and the ultraviolet light irradiation unit 160*b* (which performs irradiation when the clear ink is ejected) is defined as a second distance L2, and the first distance L1 is greater than or equal to the second distance L2.

With the above-described layout of the nozzle rows and the ultraviolet light irradiation units in the carriage 14, the period of time from when the color ink is deposited on the recording medium S to when the ultraviolet light is emitted by the ultraviolet light irradiation unit 160*a* is defined as a first time period, the period of time from when the clear ink is deposited on the recording medium S to when the ultraviolet light is emitted by the ultraviolet light irradiation unit 160*b* is defined as a second time period, and the second time period is equal to or shorter than the first time period. The clear ink is cured prior to sufficient leveling after the clear ink has been deposited. Thus, in accordance with the printing apparatus and the printing method of the embodiment, an image with an uneven surface may be formed so as to provide the textured image with a three-dimensional appearance, thereby allowing for an increase in the number of imaging effects provided by the printing apparatus.

Figure 4:
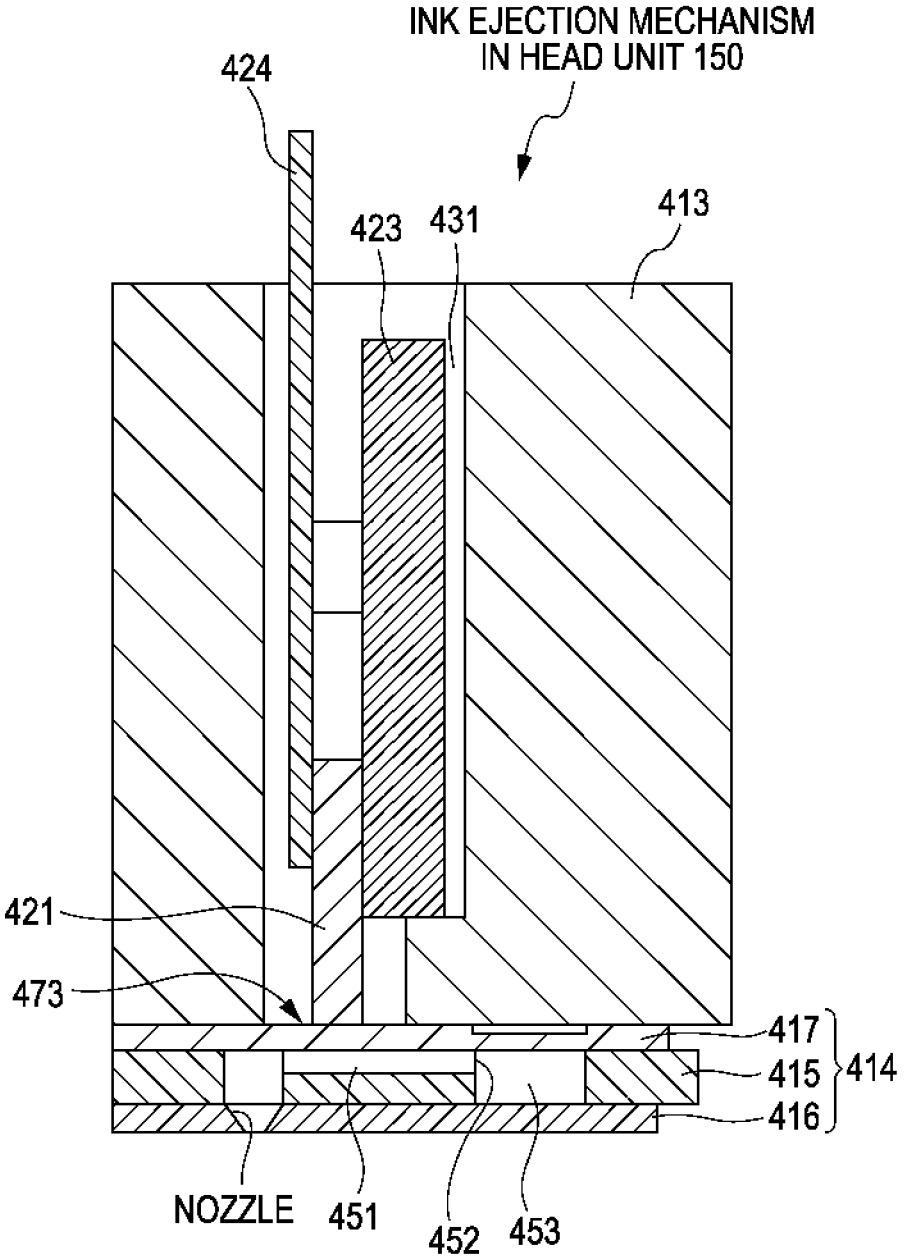
FIG. 4 is a cross-sectional view illustrating an ink ejection mechanism in the head unit.

FIG. 4 is a cross-sectional view illustrating an ink ejection mechanism in the head unit 150. Here, the structure of a drive unit for ejecting ink from each nozzle in the head unit 150 will be described with reference to the figure.

The drive unit includes a plurality of piezoelectric elements 421, a stationary plate 423 to which a group of the piezoelectric elements 421 is fixed, and a flexible cable 424 for supplying electric power to each of the piezoelectric elements 421. Each of the piezoelectric elements 421 is fixed to the stationary plate 423 in the manner of a so-called cantilever. The stationary plate 423 is a plate-shaped member with rigidity capable of receiving a reaction force from the piezoelectric element 421. The flexible cable 424 is a sheet-shaped wiring substrate with flexibility and is electrically connected to the piezoelectric element 421 at a side face of a fixing end opposite the stationary plate 423. A head control section (not illustrated) which is a control IC for controlling driving of the piezoelectric elements 421 is mounted on a surface of the flexible cable 424. The head control section is provided for each nozzle group of the head.

A flow path unit 414 includes a flow path forming substrate 415, a nozzle plate 416, and an elastic plate 417, which are integrally stacked such that the flow path forming substrate 415 is sandwiched between the nozzle plate 416 and the elastic plate 417. The nozzle plate 416 is a thin stainless steel plate having nozzles formed therein.

A plurality of cavities serving as pressure chambers 451 and ink supply openings 452 are formed in the flow path forming substrate 415, corresponding to respective nozzles. A reservoir 453 is a liquid storage chamber for supplying ink stored in an ink cartridge to each of the pressure chambers 451. The reservoir 453 communicates with an end of the corresponding pressure chamber 451 via the ink supply opening 452. The ink from the ink cartridge is introduced into the reservoir 453 through an ink supply pipe (not illustrated). The elastic plate 417 includes an island portion 473. A tip of a free end of the piezoelectric element 421 is bonded to the island portion 473.

When a drive signal is supplied to the piezoelectric element 421 via the flexible cable 424, the piezoelectric element 421 extends or contracts so as to expand or contract a volume of the pressure chamber 451. Such variation in the volume of the pressure chamber 451 results in pressure variation of the ink in the pressure chamber 451. This pressure variation of the ink allows the ink to be ejected from the nozzle.

According to the embodiment, the ink is ejected using the piezoelectric element 421. However, the method of ejecting liquid from the nozzle is not limited to this. For example, other methods, such as a method of generating bubbles in the nozzle using heat, may be employed.

Figure 5:
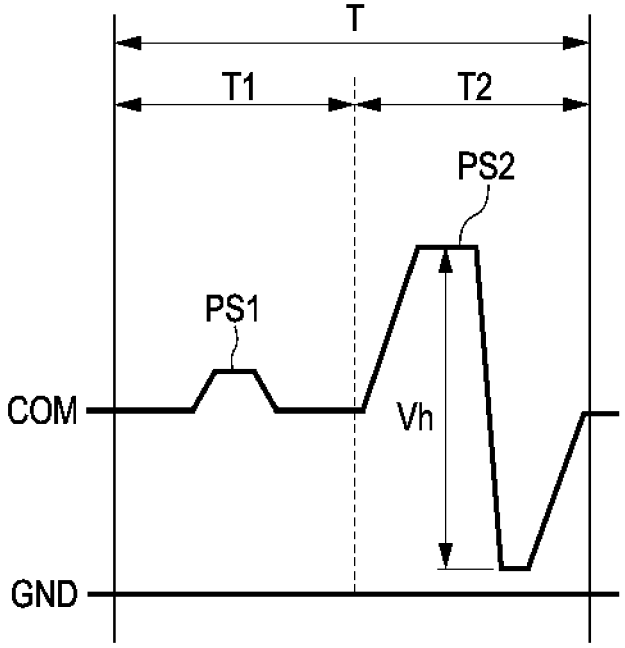
FIG. 5 illustrates an example of a drive signal COM generated by a drive signal generation circuit.

FIG. 5 illustrates an example of the drive signal COM generated by the drive signal generation circuit 117. As illustrated in the figure, the drive signal COM is repeatedly generated every repetition period T.

The period T, which is a repetition period, corresponds to a period over which the ink ejection nozzle in the carriage 14 is moved by one pixel relative to the recording medium S in the main scanning direction (first direction). For example, in the case of a print resolution of 360 dpi in the main scanning direction (first direction), the period T corresponds to a period over which the carriage 14 is moved 1/360 inch relative to the recording medium S. Drive pulses PS1 and PS2 in respective sections included in the period T are applied to the piezoelectric element 421 on the basis of pixel data included in print data, thereby allowing a dot to be formed in one pixel.

The drive signal COM has the drive pulse PS1 generated in a section T1 and the drive pulse PS2 generated in a section T2 in the repetition period.

The drive pulse PS1 is a micro-vibration pulse for finely vibrating an ink meniscus on the nozzle surface and is applied to the piezoelectric element 421 when no dot is to be formed. The drive pulse PS2 is an ink ejection pulse for forming dots and is applied to the piezoelectric element 421 when a dot is to be formed. In the figure, an amplitude Vh of the drive pulse is illustrated in the drive pulse PS2. By adjusting the amplitude Vh, the dot size may be finely adjusted.

Figure 6:
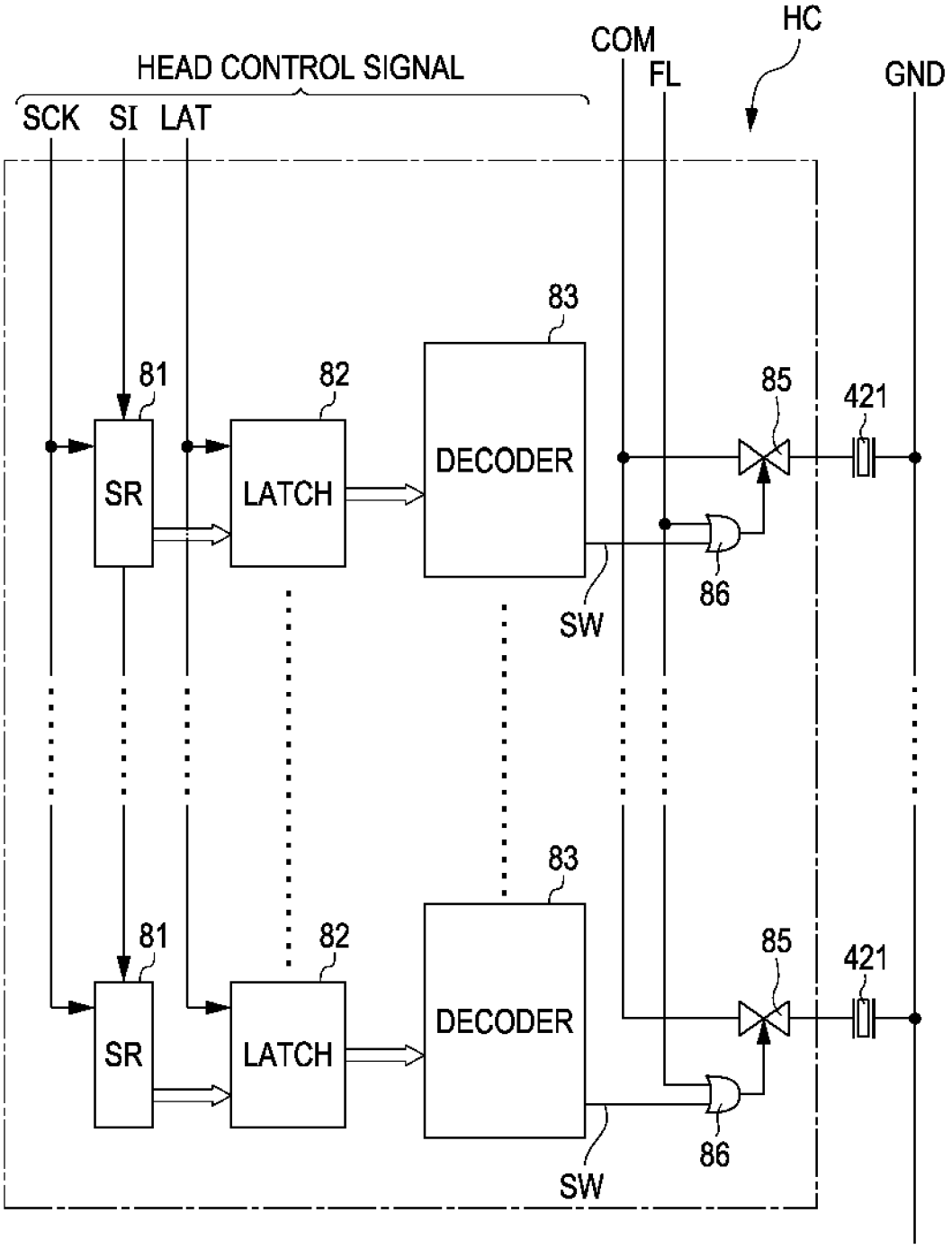
FIG. 6 illustrates an example of a circuit which drives the ink ejection mechanism in the head unit.

FIG. 6 illustrates an example of a circuit which drives the ink ejection mechanism in the head unit 150. Here, for convenience of explanation, a head control circuit HC is described as the circuit.

The head control circuit HC includes a shift register 81, a latch circuit 82, a decoder 83, a control logic 84, a switch 85 and an OR circuit 86. The shift register 81, the latch circuit 82, the decoder 83, the switch 85 and the OR circuit 86 are provided for each of the piezoelectric elements 421.

The head control circuit HC performs control for ejecting ink on the basis of pixel data SI from the controller 110. That is, the head control circuit HC controls the switch 85 on the basis of print data and thus selectively applies a necessary portion in the drive signal COM to the piezoelectric element 421.

In the embodiment, the pixel data SI is transmitted to the head control circuit HC in synchronization with a transfer clock SCK. The pixel data is included in the image data transmitted from the computer 1. The pixel data in the embodiment is data representing whether or not a dot is to be formed in each pixel in the recording medium S. The pixel data SI is composed of one bit and is determined for each nozzle Nz (piezoelectric element 421). The pixel data SI corresponding to a pixel in which no dot is formed is set to "0". The pixel data SI corresponding to a pixel in which a dot is formed is set to "1".

Each piece of the pixel data SI is set in the shift register 81. The latch circuit 82 is connected to the shift register 81. When a latch signal LAT from the controller 110 reaches an H level, each piece of the pixel data SI is latched in the corresponding latch circuit 82 and is input to the decoder 83.

The decoder 83 performs decoding on the basis of the pixel data SI and outputs a switch control signal SW for controlling the switch 85. The switch control signal SW output from the decoder 83 is input to the switch 85. The switch 85 is a switch which is turned on or off in response to the switch control signal SW and allows the drive signal COM to be applied to the piezoelectric element 421 in a period of ON. The drive signal COM from the drive signal generation circuit 117 is applied to an input side of the switch 85, and the piezoelectric element 421 is connected to an output side of the switch 85.

While the switch control signal SW is at an L level, the switch is turned off. While the switch control signal SW is at an H level, the switch is turned on. The decoder 83 performs decoding on the basis of the pixel data SI and switches between the L and H levels of the switch control signal SW at a corresponding timing.

When the pixel data SI is "0", the decoder 83 sets the switch control signal SW to the H level in the section T1 of the drive signal COM and sets the switch control signal SW to the L level in the section T2 thereof, so that the drive pulse PS1 is applied to the piezoelectric element 421. At this time, ink is not ejected from the nozzle.

When the pixel data SI is "1", the decoder 83 sets the switch control signal SW to the L level in the section T1 of the drive signal COM and sets the switch control signal SW to the H level in the section T2 thereof, so that the drive pulse PS2 is applied to the piezoelectric element 421. At this time, ink is ejected from the nozzle.

When flushing is performed, transfer of the pixel data SI in the image data from the controller 110 is temporarily stopped, during which a flushing control line FL is set to an ON state. Thus, all the drive pulses in the drive signal COM are applied to all the piezoelectric elements 421, so that ink droplets are continuously ejected, thereby allowing dots which are not based on the image data to be formed. When ink is ejected on the basis of the image data, the flushing control line FL is set to an OFF state. The switch is turned on or off in response to the switch control signal SW.

Here, the flushing is an operation of forcibly ejecting and removing ink thickened in the vicinity of ink nozzles from the nozzles to thereby supply ink with a proper viscosity in the vicinity of the nozzles. The flushing prevents ink clogging in the nozzle, so that proper printing may be performed.

In this manner, the ink is ejected on the basis of the image data, so that an image composed of dots based on the image data may be formed. Alternatively, the clear ink is ejected on the basis of the clear ink ejection data, so that an image with a glossy and/or a textured surface may be formed.

Figure 7:
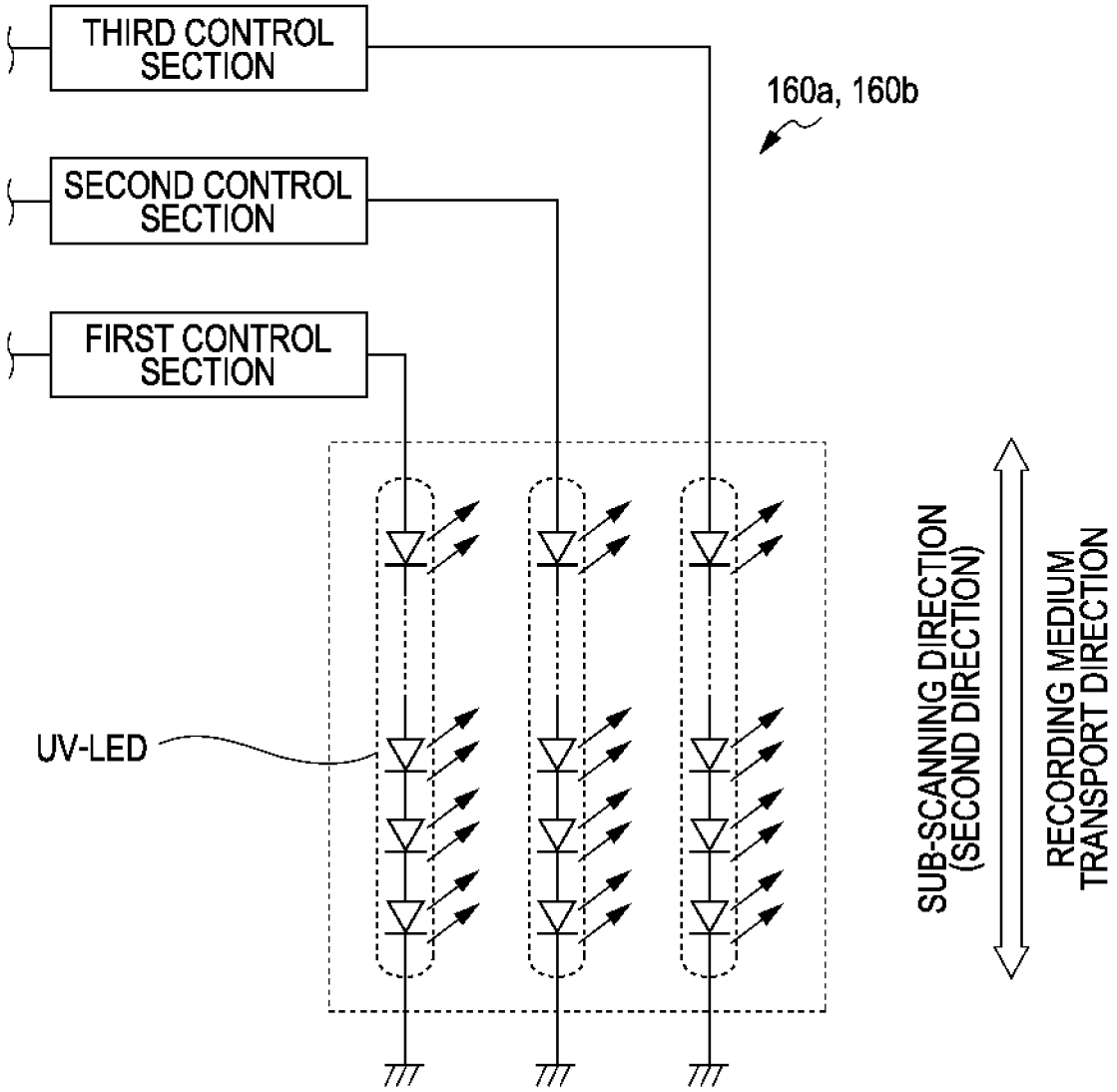
FIG. 7 illustrates an example of the structure of the ultraviolet light irradiation units used in the printing apparatus according to the embodiment of the invention.

Here, a more specific example of the structure of the ultraviolet light irradiation units 160*a* and 160*b* used in the printing apparatus 10 according to the embodiment of the invention will be described with reference to FIG. 7. FIG. 7 illustrates the example of the structure of the ultraviolet light irradiation units 160*a* and 160*b* used in the printing apparatus 10 according to the embodiment of the invention. As illustrated in FIG. 7, the ultraviolet light irradiation units 160*a* and 160*b* are each constituted by a plurality of UV-LEDs connected in series in the second direction which is the sub-scanning direction. In the example illustrated in FIG. 7, three systems of the plurality of UV-LEDs connected in series are provided. A first control section, a second control section, and a third control section are respectively connected to the three systems.

When irradiation intensities are controlled in the ultraviolet light irradiation units 160*a* and 160*b*, the UV-LEDs of any of the systems are turned on or off by these control sections; alternatively, light-emission levels of the UV-LEDs are similarly controlled by the first control section, second control section, and third control section.

Figure 8A:
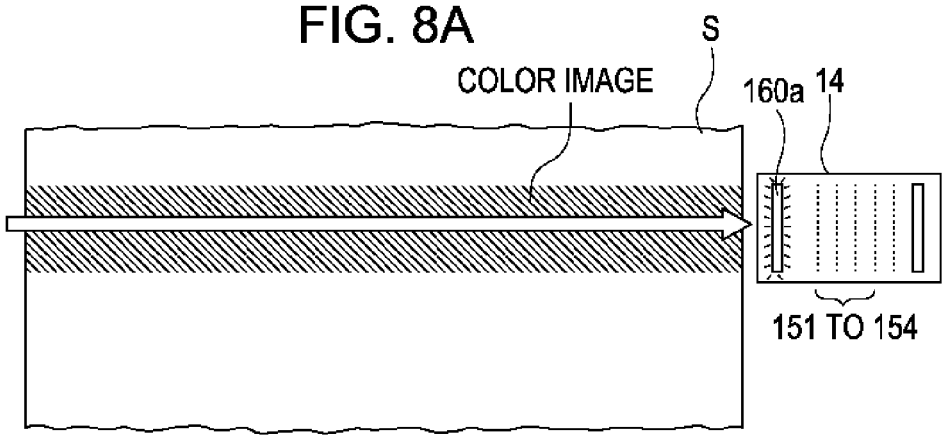
FIGS. 8A to 8C each illustrate a printing operation performed by the printing apparatus according to the embodiment of the invention.
Figure 8B:
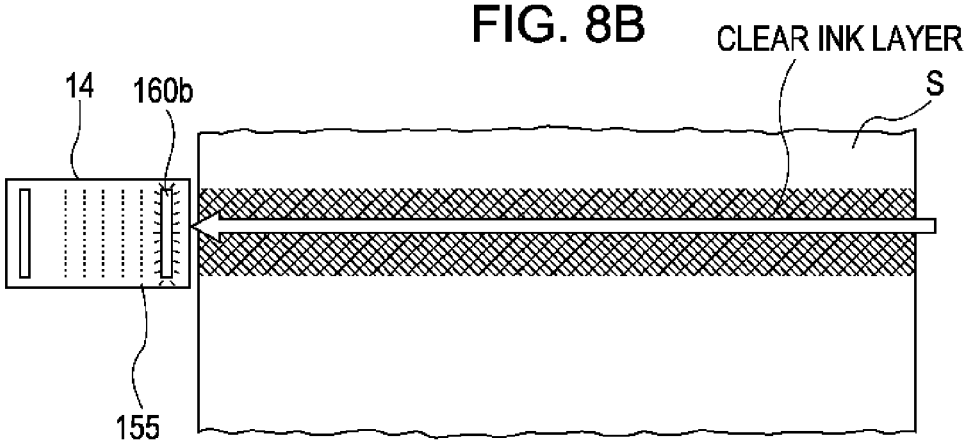
Figure 8C:
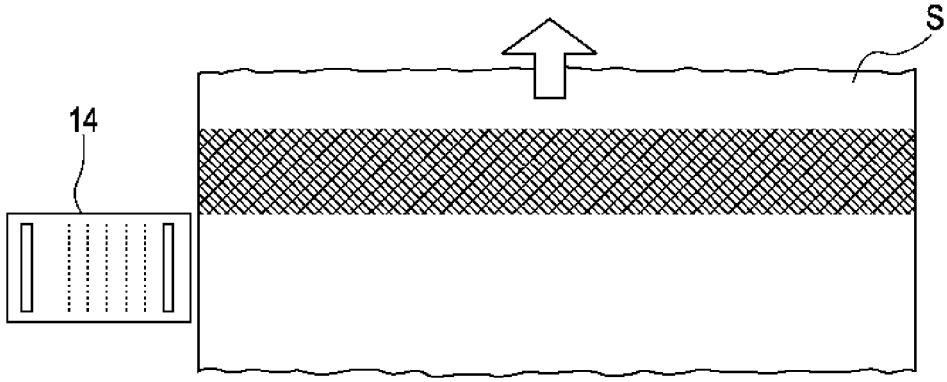

A printing operation in the printing apparatus 10 configured as described above will be described with reference to FIGS. 8A to 8C. FIGS. 8A to 8C are each a diagram of the printing apparatus 10 viewed from above and each schematically illustrate the recording medium S and the carriage 14. A right-and-left direction in the plane of the paper is the first direction in which the carriage 14 is moved and an up-and-down direction in the plane of the paper is the second direction in which the recording medium S is transported. FIGS. 8A to 8C each illustrate an operation of printing on a width (bandwidth) equivalent to the length of each of the nozzle rows 151 to 155 of the ink mounted in the carriage 14.

As illustrated in FIG. 8A, the carriage 14 is moved in the first direction, the color ink is ejected from the nozzle rows 151 to 154 of the color ink, which are moved in the first direction, so as to form a color image on the recording medium S, and the then formed color image is irradiated with ultraviolet light by the ultraviolet light irradiation unit 160*a* to be cured.

The distance between the nozzle row 151 for cyan ink ejection, which is the nozzle row of the color ink coming last in the movement direction of the carriage 14, and the ultraviolet light irradiation unit 160*a* is the first distance L1. After the color ink has been deposited on the recording medium S, the color ink is cured by irradiation with the ultraviolet light after at least the first time period over which the carriage 14 is moved by the first distance L1 has elapsed.

After the operation in FIG. 8A, as illustrated in FIG. 8B, the carriage 14 is moved in the first direction, the clear ink is ejected from the nozzle row 155 of the clear ink, which is moved in the first direction, so as to form a clear ink layer on the color image of the recording medium S, and the then formed clear ink layer is irradiated with ultraviolet light by the ultraviolet light irradiation unit 160*b*, so that the clear ink is cured.

The distance between the nozzle row 155 for clear ink ejection and the ultraviolet light irradiation unit 160*b* is the second distance L2. After the clear ink has been deposited on the recording medium S, the clear ink is cured by irradiation with the ultraviolet light after the second time period over which the carriage 14 is moved by the second distance L2 has elapsed. The second time period is set to be equal to or shorter than the first time period. In addition, the second time period is not sufficiently long to allow for leveling, which the clear ink is subjected to so as to be sufficiently flattened. The clear ink is cured before the clear ink layer is subjected to the leveling so as to be flattened, thereby allowing a textured image to be provided.

After the operation in FIG. 8B, as illustrated in FIG. 8C, the recording medium S is moved by the bandwidth in the second direction by the transport rollers 13 so that printing may be performed on a subsequent bandwidth.

FIGS. 9A and 9B are schematic diagrams illustrating the difference between surface states corresponding to different periods of time from ink deposition to ink curing. FIG. 9A schematically illustrates a surface state in the case where the period of time (second time period) from when the clear ink is deposited to when the ultraviolet light is emitted by the ultraviolet light irradiation unit 160*b* is equal to or shorter than the first time period.

In the case where the period of time to when the ejected clear ink layer is irradiated with the ultraviolet light by the ultraviolet light irradiation unit 160*b* is the second time period and is shorter than or equal to the first time period, the clear ink is cured before the clear ink layer is subjected to the leveling so as to be flattened, so that a surface layer of the clear ink layer becomes uneven as illustrated in FIG. 9A. Consequently, a color image layer which is a base may be given a textured surface.

On the other hand, in the case where the period of time to when the ejected clear ink layer is irradiated with the ultraviolet light by the ultraviolet light irradiation unit 160*b* is longer than the first time period, the clear ink is cured after the clear ink layer has been subjected to the leveling so as to be practically flattened, so that the surface layer of the clear ink layer becomes flat as illustrated in FIG. 9B. Consequently, the color image layer which is the base is given a glossy surface.

In the printing apparatus and the printing method of the embodiment, the period of time from when color ink is deposited on a medium to when light is emitted by a light irradiation section (ultraviolet light irradiation unit 160*a*) is defined as a first time period, the period of time from when clear ink is deposited on the medium to when light is emitted by the light irradiation section (ultraviolet light irradiation unit 160*b*) is defined as a second time period, and the second time period is equal to or shorter than the first time period. The clear ink is cured prior to sufficient leveling after the clear ink has been deposited. Thus, in accordance with the printing apparatus and the printing method of the embodiment, an image with an uneven surface may be formed so as to provide a textured image with a three-dimensional appearance, thereby allowing for an increase in the number of imaging effects provided by the printing apparatus.

Next, another embodiment of the invention will be described. In this embodiment as well, the period of time from when a clear ink layer is ejected to when this is cured is set to a first time period or less, and thus the clear ink layer becomes uneven, so that an image is given a textured surface. In this embodiment, the configuration of a carriage 14 is different from that in the above-described embodiment and different points therein will be described below.

Figure 10:
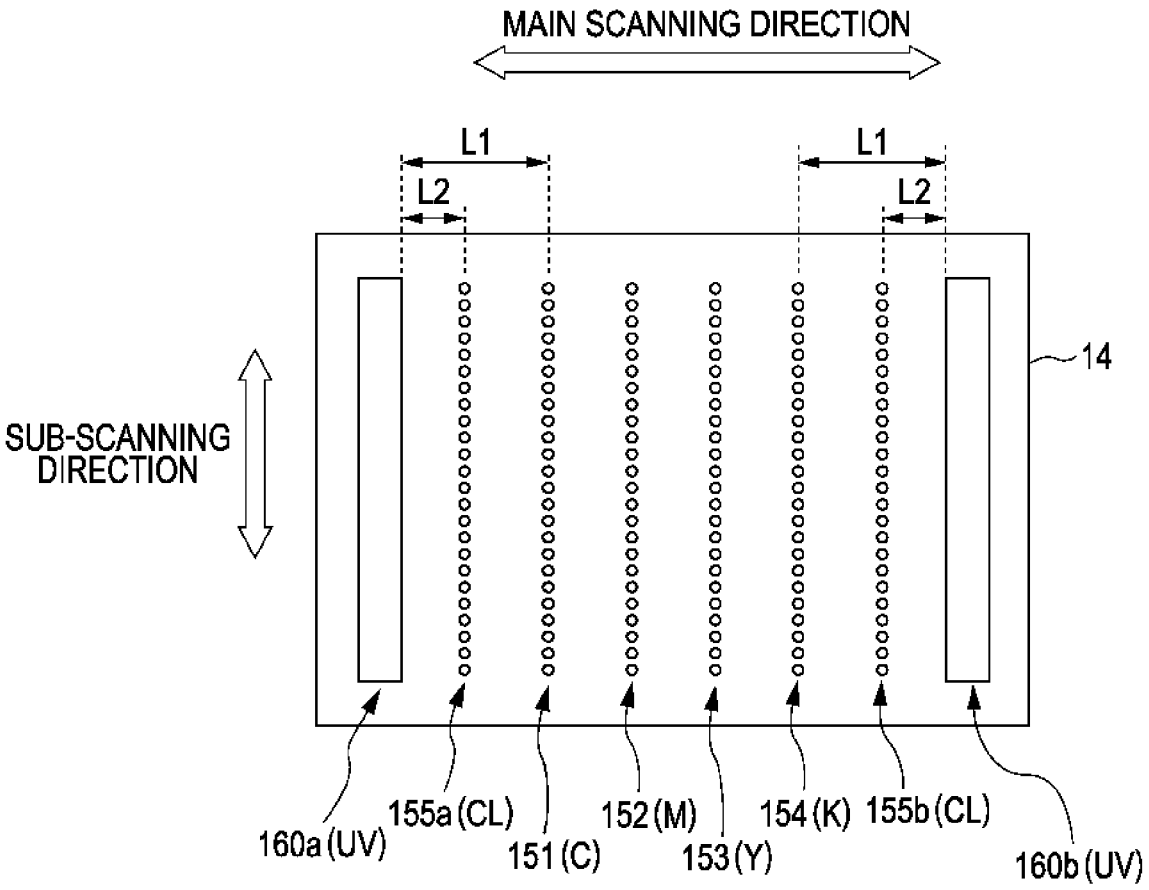
FIG. 10 schematically illustrates the bottom of a carriage (surface facing a recording medium) of a printing apparatus according to another embodiment of the invention.

FIG. 10 schematically illustrates the bottom of the carriage 14 (surface facing a recording medium S) of a printing apparatus 10 according to the other embodiment of the invention.

As illustrated in FIG. 10, in this embodiment, two nozzle rows 155 for clear ink ejection are provided. One is a nozzle row 155*a* disposed in a position close to an ultraviolet light irradiation unit 160*a* and the other one is a nozzle row 155*b* disposed in a position close to an ultraviolet light irradiation unit 160*b*.

A nozzle row 151 for cyan ink ejection, a nozzle row 152 for magenta ink ejection, a nozzle row 153 for yellow ink ejection, and a nozzle row 154 for black ink ejection are interposed between the nozzle rows 155*a* and 155*b* for clear ink ejection.

A first example of a printing operation performed by the printing apparatus 10 including the carriage 14 configured as described above will be described with reference to FIGS. 11A to 11C.

Figure 11A:
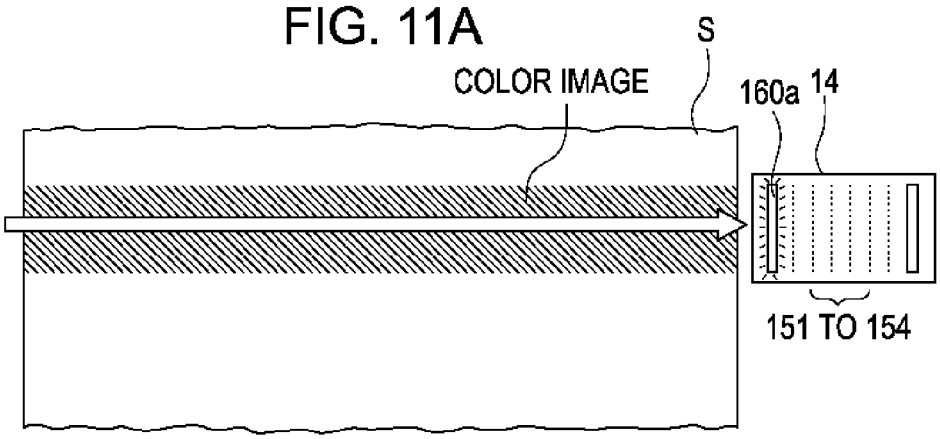
FIGS. 11A to 11C each illustrate a printing operation performed by the printing apparatus according to the other embodiment of the invention.
Figure 11B:
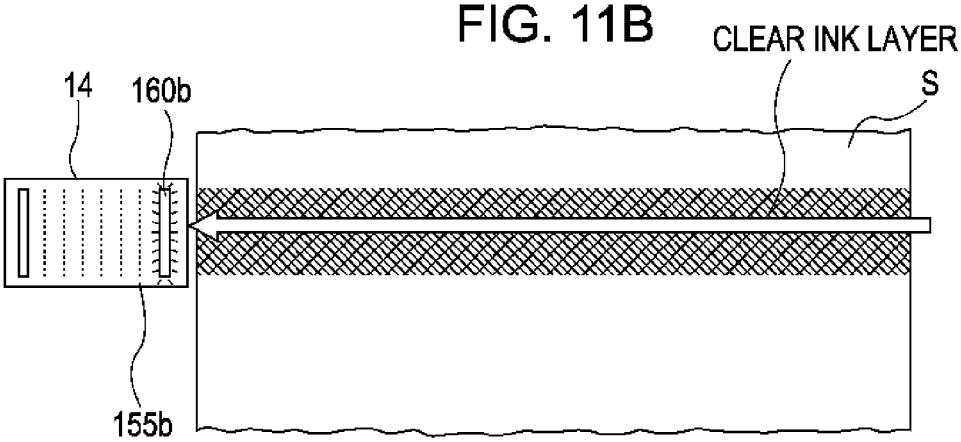
Figure 11C:
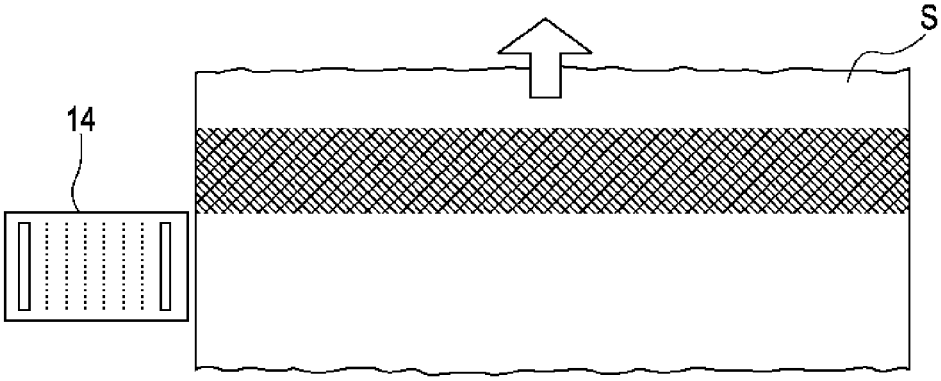

FIGS. 11A to 11C are each a diagram of the printing apparatus 10 viewed from above and each schematically illustrate the recording medium S and the carriage 14. A right-and-left direction in the plane of the paper is a first direction in which the carriage 14 is moved and an up-and-down direction in the plane of the paper is a second direction in which the recording medium S is transported. FIGS. 11A to 11C each illustrate an operation of printing on a width (bandwidth) equivalent to the length of each of the nozzle rows 151 to 155 of the ink mounted in the carriage 14.

As illustrated in FIG. 11A, the carriage 14 is moved in the first direction, color ink is ejected from the nozzle rows 151 to 154 of the color ink, which are moved in the first direction, so as to form a color image on the recording medium S, and the then formed color image is irradiated with ultraviolet light by the ultraviolet light irradiation unit 160*a* to be cured.

The distance between the nozzle row 151 for cyan ink ejection, which is the nozzle row of the color ink coming last in the movement direction of the carriage 14, and the ultraviolet light irradiation unit 160*a* is a first distance L1. After the color ink has been deposited on the recording medium S, the color ink is cured by irradiation with the ultraviolet light after at least the first time period over which the carriage 14 is moved by the first distance L1 has elapsed.

After the operation in FIG. 11A, as illustrated in FIG. 11B, the carriage 14 is moved in the first direction, clear ink is ejected from the nozzle row 155*b* of the clear ink, which is moved in the first direction, so as to form a clear ink layer on the color image of the recording medium S, and the then formed clear ink layer is irradiated with ultraviolet light by the ultraviolet light irradiation unit 160*b*, so that the clear ink is cured.

The distance between the nozzle row 155*b* for clear ink ejection and the ultraviolet light irradiation unit 160*b* is a second distance L2. After the clear ink has been deposited on the recording medium S, the clear ink is cured by irradiation with the ultraviolet light after a second time period over which the carriage 14 is moved by the second distance L2 has elapsed. The second time period is set to be equal to or shorter than the first time period. In addition, the second time period is not sufficiently long to allow for leveling, which the clear ink is subjected to so as to be sufficiently flattened. The clear ink is cured before the clear ink layer is subjected to the leveling so as to be flattened, thereby allowing a textured image to be provided.

After the operation in FIG. 11B, as illustrated in FIG. 11C, the recording medium S is moved by the bandwidth in the second direction by transport rollers 13 so that printing may be performed on a subsequent bandwidth.

A second example of the printing operation performed by the printing apparatus 10 according to the other embodiment will be described with reference to FIGS. 12A to 12C.

Figure 12A:
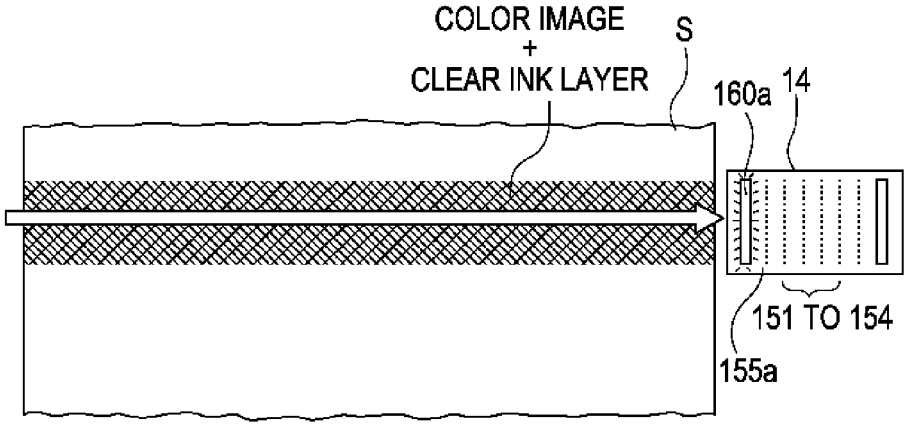
FIGS. 12A to 12C each illustrate a printing operation performed by the printing apparatus according to the other embodiment of the invention.
Figure 12B:
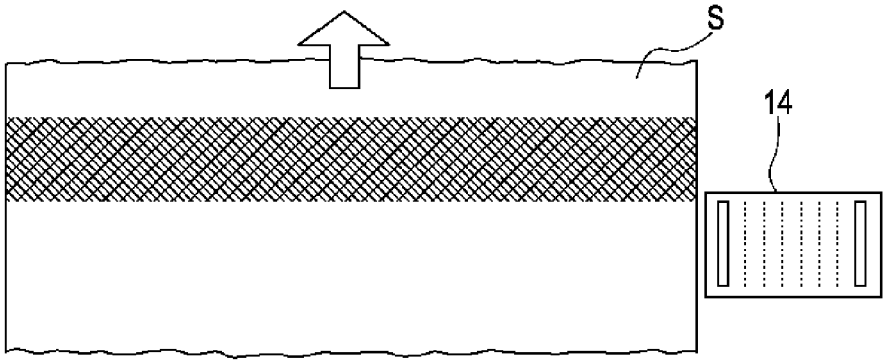
Figure 12C:
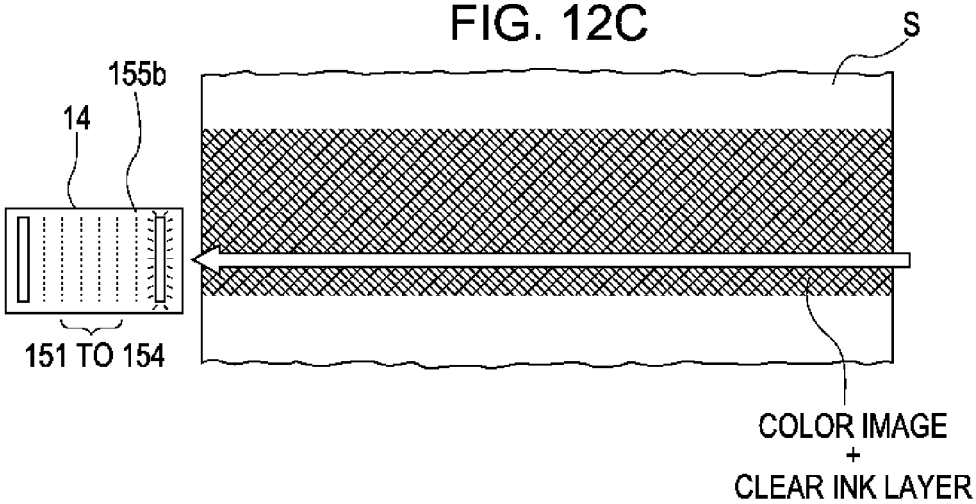

FIGS. 12A to 12C are each a diagram of the printing apparatus 10 viewed from above and each schematically illustrate the recording medium S and the carriage 14. A right-and-left direction in the plane of the paper is a first direction in which the carriage 14 is moved and an up-and-down direction in the plane of the paper is a second direction in which the recording medium S is transported. FIGS. 12A to 12C each illustrate an operation of printing on a width (bandwidth) equivalent to the length of each of the nozzle rows 151 to 155 of the ink mounted in the carriage 14.

As illustrated in FIG. 12A, the carriage 14 is moved in the first direction, color ink is ejected from the nozzle rows 151 to 154 of the color ink which are moved in the first direction and clear ink is ejected from the nozzle row 155*a* of the clear ink to thereby form a color image and a clear ink layer on the recording medium S, and the then formed color image and clear ink layer are irradiated with ultraviolet light by the ultraviolet light irradiation unit 160*a*, so that the color image is cured.

The distance between the nozzle row 155*a* for clear ink ejection coming last in the movement direction of the carriage 14 and the ultraviolet light irradiation unit 160*a* is a second distance L2. After the clear ink has been deposited on the recording medium S, the clear ink is cured by irradiation with the ultraviolet light after a second time period over which the carriage 14 is moved by the second distance L2 has elapsed. The second time period is not sufficiently long to allow for leveling, which the clear ink is subjected to so as to be sufficiently flattened. The clear ink is cured before the clear ink layer is subjected to the leveling so as to be flattened, thereby allowing a textured image to be provided.

After the operation in FIG. 12A, as illustrated in FIG. 12B, the recording medium S is moved by the bandwidth in the second direction by transport rollers 13 so that printing may be performed on a subsequent bandwidth.

As illustrated in FIG. 12C, the carriage 14 is moved in the first direction, the color ink is ejected from the nozzle rows 151 to 154 of the color ink which are moved in the first direction and clear ink is ejected from the nozzle row 155*b* of the clear ink to thereby form a color image and a clear ink layer on the recording medium S, and the then formed color image and clear ink layer are irradiated with ultraviolet light by the ultraviolet light irradiation unit 160*b*, so that the color image is cured.

The distance between the nozzle row 155*b* for clear ink ejection coming last in the movement direction of the carriage 14 and the ultraviolet light irradiation unit 160*b* is the second distance L2. After the clear ink has been deposited on the recording medium S, the clear ink is cured by irradiation with the ultraviolet light after the second time period over which the carriage 14 is moved by the second distance L2 has elapsed. The second time period is not sufficiently long to allow for leveling, which the clear ink is subjected to so as to be sufficiently flattened. The clear ink is cured before the clear ink layer is subjected to the leveling so as to be flattened, thereby allowing a textured image to be provided.

Thus, in accordance with the other embodiment of the invention as well, an image with an uneven surface may be formed so as to provide the textured image with a three-dimensional appearance, thereby allowing for an increase in the number of imaging effects provided by the printing apparatus 10.

In accordance with each embodiment of the invention, the movement speed of the carriage is controlled. However, other embodiments of the invention are not limited to the printing apparatus in which the carriage is moved. For example, an embodiment of the invention may be applied to a so-called line head-type printing apparatus in which a head is disposed along a width direction of a medium as an object to be subjected to ejection, such as paper. In such a case, the embodiment may be implemented by controlling/adjusting the period of time between a first time period for a first operation from ejection of color ink from a line head to curing of the color ink and a second time period for a second operation from ejection of clear ink from the line head to curing of the clear ink. (For example, the second time period is longer than the first time period.) In this case, a first light irradiation section used in the first operation and a second light irradiation section used in the second operation are separately provided, a first distance between the first light irradiation section and a color ink ejection nozzle and a second distance between the second light irradiation section and a clear ink ejection nozzle may be set as appropriate. (For example, each nozzle and each light irradiation section are arranged such that the second distance is greater than the first distance.)

The entire disclosure of Japanese Patent Application No. 2011-163101, filed on Jul. 26, 2011 is expressly incorporated by reference herein.

What is claimed is:

1. A printing apparatus comprising:

a carriage movable in a first direction relative to a medium;

a recording head that is provided in the carriage and that ejects color ink or clear ink which is cured by irradiation with light;

a plurality of color ink nozzle rows that are provided in the recording head and that eject the color ink which is cured by irradiation with light;

a clear ink nozzle row that is provided in the recording head and that ejects the clear ink which is cured by irradiation with light;

a movement mechanism that performs relative movement of the carriage and the medium in a second direction that is perpendicular to the first direction; and a light irradiation section that is provided in the carriage and that emits light, a controller configured to control timing of ejection of the color ink from the plurality of color ink nozzle rows, ejection of the clear ink from the clear ink nozzle row, and the light irradiation section emitting light, wherein a period of time from when the color ink is deposited on the medium to when light is emitted by the light irradiation section toward the color ink as controlled by the controller is defined as a first time period, a period of time from when the clear ink is deposited on the medium to when light is emitted by the light irradiation section toward the clear ink as controlled by the controller is defined as a second time period, and the second time period is equal to or shorter than the first time period, wherein the light irradiation section includes a first light irradiation section located on a first side of the carriage and a second light irradiation section located on a second side of the carriage, the plurality of color ink nozzle rows and the clear ink nozzle row being in between the first and second light irradiation sections, wherein a distance in the first direction between a first color nozzle row of the plurality of color ink nozzle rows that is closest to the first light irradiation section and the first light irradiation section is defined as a first distance, a distance in the first direction between the clear ink nozzle row and the second light irradiation section is defined as a second distance, and the first distance is greater than the second distance, wherein the first color nozzle row is the closest nozzle row, among all nozzle rows, to the first light irradiation section.

2. A printing apparatus comprising:

a carriage movable in a first direction relative to a medium;

a recording head that is provided in the carriage and that ejects color ink or clear ink which is cured by irradiation with light;

a plurality of color ink nozzle rows that are provided in the recording head and that eject the color ink which is cured by irradiation with light;

a clear ink nozzle row that is provided in the recording head and that ejects the clear ink which is cured by irradiation with light;

a movement mechanism that performs relative movement of the carriage and the medium in a second direction that is perpendicular to the first direction; and a light irradiation section that is provided in the carriage and that emits light, wherein the light irradiation section includes a first light irradiation section located on a first side of the carriage and a second light irradiation section located on a second side of the carriage, the plurality of color ink nozzle rows and the clear ink nozzle row being in between the first and second light irradiation sections; and a controller configured to control timing of ejection of the color ink from the color ink nozzle row, ejection of the clear ink from the clear ink nozzle row, and the light irradiation section emitting light, wherein a distance in the first direction between a first color nozzle row of the plurality of color ink nozzle rows that is closest to the first light irradiation section and the first light irradiation section is defined as a first distance, a distance in the first direction between the clear ink nozzle row and the second light irradiation section is defined as a second distance, and the first distance is greater than the second distance, wherein the first color nozzle row is the closest nozzle row, among all nozzle rows, to the first light irradiation section.

* * * * *